United States Patent [19]

Miki et al.

[11] Patent Number: 4,571,570

[45] Date of Patent: Feb. 18, 1986

[54] WINDING FOR STATIC INDUCTION APPARATUS

[75] Inventors: Atsushi Miki; Etsunori Mori; Minoru Hoshi; Masaru Higaki, all of Hitachi, Japan

[73] Assignee: Hitachi, Ltd., Tokyo, Japan

[21] Appl. No.: 658,413

[22] Filed: Oct. 5, 1984

Related U.S. Application Data

[62] Division of Ser. No. 240,858, Mar. 5, 1981, abandoned.

[30] Foreign Application Priority Data

Mar. 5, 1980 [JP] Japan ..... 55-26666

[51] Int. Cl.[4] ..... H01F 15/14

[52] U.S. Cl. ..... 336/70; 336/187; 336/223

[58] Field of Search ..... 336/69, 70, 186, 187, 336/223

[56] References Cited

U.S. PATENT DOCUMENTS

| | | | |
|---|---|---|---|
| 1,641,658 | 9/1927 | Brand | 336/70 X |
| 2,879,354 | 4/1958 | Sealey | 336/69 |
| 2,905,911 | 9/1959 | Kurita | 336/70 |
| 3,106,690 | 10/1963 | Angermeyer | 336/70 |
| 3,387,243 | 6/1968 | Carpenter | 336/70 |
| 3,392,326 | 7/1968 | Lambenton | 336/70 X |
| 3,528,046 | 9/1970 | Sayer | 336/70 |
| 3,560,902 | 2/1971 | Okuyama | 336/70 |
| 3,564,470 | 2/1971 | Van Nice | 336/70 X |
| 3,705,371 | 12/1972 | Van Vice | 336/70 |
| 3,781,739 | 12/1973 | Meyer | 336/187 |

FOREIGN PATENT DOCUMENTS

| | | | |
|---|---|---|---|
| 1526293 | 4/1968 | France | 336/70 |
| 40-16291 | 7/1965 | Japan . | |
| 51-92025 | 12/1976 | Japan . | |
| 55-21168 | 2/1980 | Japan | 336/70 |

*Primary Examiner*—Thomas J. Kozma

*Attorney, Agent, or Firm*—Antonelli, Terry & Wands

[57] ABSTRACT

A winding for a static induction apparatus such as a transformer, a reactor and the like comprises a plurality of interleaved coils each formed by winding an electrically insulated strand conductor in a radial spiral. The coils are stacked axially and electrically connected in series between a line terminal and another terminal such as a neutral terminal. The winding is divided into a plurality of blocks each including a plurality of ones of the interleaved coils. The number of turns of each coil belonging to the block on the other terminal side is decreased as compared with that of each coil belonging to the block located closer to the line terminal, to thereby reduce the series electrostatic capacitance of the coils stepwise from one to another block starting from the one located on the line terminal side. The distribution constant is thus decreased. Favorable surge withstanding characteristics are attained, reliable insulation is assured and the winding can be realized in a reduced size.

3 Claims, 11 Drawing Figures

WINDING FOR STATIC INDUCTION APPARATUS

This is a division of application Ser. No. 240,858 filed Mar. 5, 1981, now abandoned.

The present invention relates to a high voltage winding for a static induction apparatus such as a transformer, a reactor and the like. The invention is directed particularly to the winding for the static induction apparatus which exhibits a high series electrostatic capacitance effective for improving the surge withstanding characteristics and enhancing reliability in respect of insulation.

In general, an iron core type transformer, a typical one of the static induction apparatus, comprises at least a low voltage winding and a high voltage winding wound around a leg portion of an iron core. In particular, the high voltage winding is commonly constituted by a disk winding which comprises a plurality of disk-like or annular coils stacked axially and connected electrically in series, wherein each of the disk-like coils is formed by winding in a disk-like or radial spiral form a strand conductor usually insulated by an insulation sheet material such as kraft paper.

It is required that the disk winding for the transformer be capable of withstanding a steep wave front impulse voltage such as lightning surge which enters the transformer at a line terminal thereof. However, the disk winding characteristically exhibits, when exposed to a steep wave front impulse voltage such as the surge voltage, a non-linear voltage distribution along all the length of the strand conductor from turn to turn, from coil to coil and from coil to the earth, as is well known in the art.

Upon impression of the steep wave front impulse voltage (hereinafter referred to also as surge voltage) across the winding of the transformer, there is induced in the winding a transient potential oscillation in the course of transition from a state of initial potential distribution which is determined by an electrostatic capacitance to earth of the winding and a series electrostatic capacitance of the winding to a state of steady potential distribution which is determined by inductance of the winding. It is also well known that as the difference between the initial potential distribution and the steady potential distribution becomes smaller, the transient potential oscillation becomes more attenuated.

In general, the non-linearity of distribution of the surge voltage is represented by the magnitude of a distribution constant $\alpha$ which is given by an expression that $$\alpha = \sqrt{\frac{C_g}{C_s}},$$

where $C_g$ represents the electrostatic capacitance between the coils and the earth i.e. capacitance to earth of the winding and $C_s$ represents a series electrostatic capacitance between the individual turns. The distribution of the surge voltage becomes more linear, as the distribution constant $\alpha$ is smaller.

In order to uniformize the distribution of the transient voltage ascribable to the transient potential oscillation which takes place upon entrance or impression of the steep wave front impulse or surge voltage, it is conceived that the series capacitance $C_s$ should be as large as possible to thereby uniformize the initial potential distribution which is determined solely be the electrostatic capacitance, as is obvious from the expression concerning the distribution constant $\alpha$. To this end, there have been proposed a so-called interleaved winding in which the strand conductors are interlaced with each other in winding the disk-like or annular coil (reference is to be made to U.S. Pat. No. 3,828,045, for example) and an electrostatically shielded winding in which a shielding conductor is interposed within the coil structure (refer to U.S. Pat. No. 2,905,911, for example).

An attempt to increase the series static capacitance $C_s$ inevitably involves an increased volume occupied by the winding in the transformer as well as high expensiveness of the latter. However, when distribution of the series capacitance is made in such a manner that it is decreased progressively from the line terminal side (high voltage end) to the earth side (low voltage end) of the winding, it is possible to uniformize sufficiently the initial voltage distribution and hence the distribution of voltage ascribable to the transient potential oscillation without increasing excessively the overall series capacitance.

In the case of the winding of electrostatically shielded structure for suppressing the transient potential oscillation, there is a great deal of freedom in determing the number of turns as well as the electrical connection of the shielding conductors interlaced with the main conductors. Accordingly, the series static capacitance can be easily decreased stepwise to thereby reduce the volume occupied by the winding in the transformer in a reasonable manner.

On the other hand, the interleaved winding has been based on such a principle that in order to provide the progressive or stepwise decreasing of the series electrostatic capacitance starting from the line terminal side (or high voltage end) toward other terminal such as a neutral point terminal, the interleaved coils may be wound in such a manner that potential differences between adjacent turns of the interlaced strand conductors are increased stepwise so as to increase the capacitance between the respective strand conductors, to thereby correspondingly increase the equivalent series capacitance. More specifically, the potential difference between the adjacent turns of the interlaced conductor which forms a coil is increased by varying the manner in which the strand conductor is interlaced or interleaved in winding the disk-like coils. It is also known to divide the individual conductor into a plurality of strands which are electrically connected in parallel with each other, to thereby increase the equivalent active area of the conductors which play a role in forming the electrostatic capacitance. Of course, the two types of winding methods described above may be adopted in combination. However, a large amount of manufacturing cost will be required to realize the interleaved winding exhibiting the desired impulse voltage withstanding characteristics by resorting to the hitherto known winding methods such as described above, involving a disadvantage that such expensive winding is impractical from the economical view point.

In conjunction with a transformer winding of the interleaved structure, a proposal has been made as to the decreasing of the series static capacitance in a step-by-step manner starting from the line terminal toward other terminal such as a neutral terminal in Japanese Laid-Open Patent Application No. 92025/1976. According to the disclosure of this prior art reference, the interleaved winding is constituted by a plurality of annular or disk-like coils which are formed by winding a strand conductor or conductors coated with a suitable insulating material and which are coaxially stacked in the axial direction of the winding and sequentially connected in a series circuit relation between the line terminal and the other terminal such as the neutral terminal, wherein the winding is divided into a predetermined number of sections or blocks, e.g. three blocks, each including a predetermined number of the disk-like coils. The coils belonging to the different blocks are so formed as to exhibit different series capacitances. More particularly, those coils which belong to the first block disposed on the side of the line terminal (i.e. on the high voltage end side) are wound in the interleaved structure in which the turns of the strand conductor are alternately interleaved or interlaced so as to present a high series capacitance and first insulation spacers are disposed on the inner most side of the coils facing the other winding in an effort to reinforce the electric insulation of these coils disposed closer to the line terminal or high voltage end. In the second block succeeding the first block, the coils belonging to this block are also wound in the interleaved structure similar to the coils of the first block. However, in each of the coils belonging to the second block, a plurality of second thin insulation spacers are disposed between the adjacent turns of the strand conductor in a dispersed manner, wherein the thickness of each second insulation spacer is so selected that the sum of the thicknesses of all the second insulation spacers is substantially equal to the thickness of the first insulation spacer mentioned above. The coil belonging to the second block or group thus presents a lower series static capacitance because the capacitance between the adjacent turns is decreased by the provision of the second insulation spacers. In the third block located closer to the other terminal (or low voltage end of the winding), each coil is constituted by the conventional disk-like or annular coil realized by winding a single strand conductor in a non-interleaved manner and having a number of turns increased by a number of the insulation spacers spaced in this block. In this way, the winding composed of a number of the coil blocks of different arrangements is imparted with the series static capacitance which is decreased progressively or stepwise from one to another block starting from the block located on the line terminal side toward the other terminal and thus exhibits improved surge voltage withstanding characteristics. However, the winding of this structure suffers a disadvantage that the space factor of the winding is lowered due to the provision of the first and the second insulation spacers, involving an increased volume of the winding. Further, this structure of the winding is considered unpreferable from the viewpoint of decreasing the series static capacitance which is inherent to the coil. An interleaved winding of the structure similar to that of the above-mentioned is also disclosed in U.S. Pat. No. 3,387,243.

An object of the present invention is to provide an improved structure of a winding for a static induction apparatus such as a transformer, a reactor and the like in which potential distribution along the axis of the winding is made more uniform throughout from the line terminal side to the other terminal side and which exhibits improved surge or impulse voltage withstanding characteristics as well as an enhanced reliability of insulation and, besides, allows the volume of the winding to be reduced.

According to an aspect of the invention there is proposed a winding for a static induction apparatus which comprises a plurality of interleaved coils connected sequentially in series to one another between a line terminal and another terminal such as neutral point terminal, the winding being divided into a predetermined number of blocks or groups each including a plurality of the interleaved coils, wherein the number of turns of the interleaved coil belonging to the block located on the other terminal side is decreased as compared with the number of turns of the interleaved coils belonging to the block disposed on the line terminal side.

The object as mentioned above and other objects of the present invention will become apparent as the description proceeds in conjunction with the appended drawings wherein:

FIG. 1 schematically illustrates a winding for a static induction apparatus according to an exemplary embodiment of the invention;

In the following, description will be made of the preferred embodiments of the invention on the assumption that the winding for a static induction is applied to a transformer winding.

Figure 1:
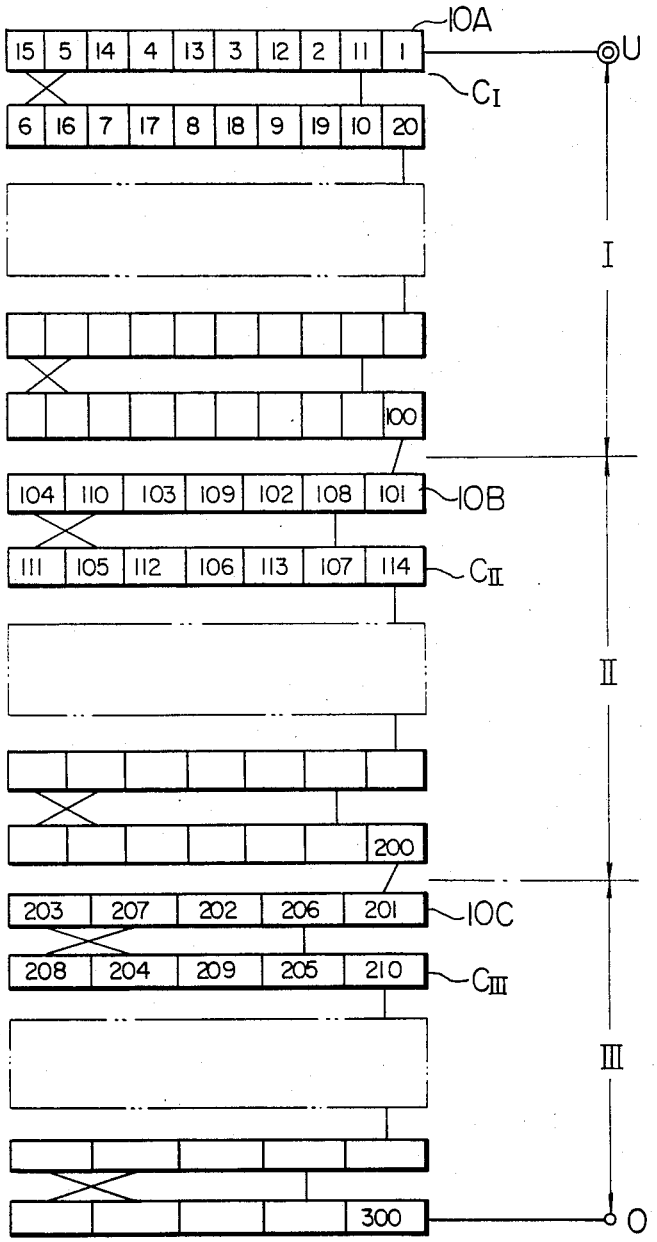

Referring to FIG. 1, the transformer winding as illustrated comprises a plurality of coils each of an interleaved structure in which a single or more strand conductors coated with a suitable insulation material is or are wound alternately radially inward and radially outward or vice versa. These disk-like coils of the interleaved structure are stacked coaxially in the axial direction of the winding and electrically connected sequentially in series between a line terminal U and another terminal 0 such as a neutral point terminal.

The transformer winding is divided into, for example, three blocks or groups designated by I, II and III between the line terminal U and the other terminal O such as the neutral point terminal or a line terminal of an intermediate voltage. The coil blocks I, II and III include a plurality of coils $C_I$, a plurality of coils $C_{II}$ and a plurality of coils $C_{III}$, respectively, of the interleave structure which are stacked axially and are electrically connected sequentially in a series circuit relation.

The interleaved coils $C_I$, $C_{II}$ and $C_{III}$ of the respective blocks I, II and III are of the identical interleave structure with the two outermost turns of the coils being connected in an interlaced fashion. However, the number of turns of the interleaved coil differs from one to another block. More specifically, when the number of turns of the coils belonging to the blocks I, II and III are represented by $N_I$, $N_{II}$, $N_{III}$, then the numbers of turns of the coils in these blocks are so selected that $N_I > N_{II} > N_{III}$. In other words, the number of turns of the coils is decreased stepwise from the block I to II and hence to III so that the relation: $N_I > N_{II} > N_{III}$ applies valid.

Figure 2A:
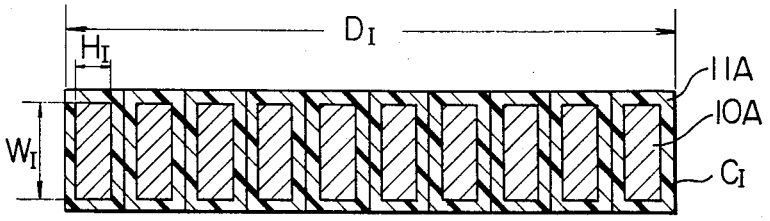
FIGS. 2A and 2B show coils used in the winding shown in FIG. 1 in enlarged sectional views.
Figure 2B:
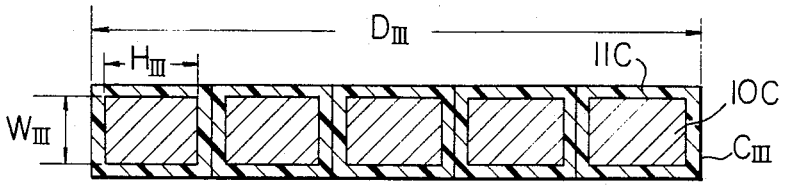

For adjusting the different numbers of turns of the interleaved coils $C_I$, $C_{II}$ and $C_{III}$ belonging to the blocks I, II and III, respectively, the size or dimension of the interlaced strand conductors 10A, 10B and 10C of the coils $C_I$, $C_{II}$ and $C_{III}$ are correspondingly varied in the case of the illustrated embodiment, although adjusting pieces or spacers of an insulation material may be used for the same purpose. In more concrete terms, in the case of the interleaved coils $C_I$ belonging to the block I located closest to the line terminal U, the dimension $H_I$ of the strand conductor 10A in the radial direction of the coil is selected smaller as compared with the corresponding dimensions of the strand conductors 10B and 10C of the coils $C_{II}$ and $C_{III}$ belonging to the other blocks II and III, while the dimension $W_I$ of the strand conductor 10A in the axial direction of the stacked coils is selected larger as compared with the corresponding ones of the other strands 10B and 10C, whereby the number of turns $N_I$ of the coil $C_I$ is increased, as is illustrated in FIG. 2A. The strand conductor 10A is coated with a suitable insulation material 11A such as kraft paper. On the contrary, the strand conductor 10C which constitutes the interleaved coil $C_{III}$ belonging to the block III disposed closest to the other terminal O has a greater dimension $H_{III}$ in the radial direction of the coil and a smaller dimension $W_{III}$ in the axial direction of the stacked coils, whereby the number of turns $N_{III}$ of the coil $C_{III}$ is decreased, as can be seen from FIG. 2B. The strand conductor 10C is also coated with the insulation material 11C. Finally, the strand conductor forming the coil $C_{II}$ belonging to the block II is imparted with intermediate dimensions both in the radial and axial directions and coated with an insulation material, although not shown in the drawing whereby the number of turns $N_{II}$ of the coil $C_{II}$ is correspondingly determined.

In this manner, it is possible to manufacture a transformer winding without giving rise to noticeable variations in the radial dimensions $D_I$, $D_{II}$ and $D_{III}$ of the coils $C_I$, $C_{II}$ and $C_{III}$ by employing the strand conductors 10A, 10B and 10C of different dimensions in the radial and axial directions for forming the respective coils. Further, since the individual strand conductors 10A, 10B and 10C for forming the respective interleaved coils $C_I$, $C_{II}$ and $C_{III}$ may have a substantially identical sectional area, the current density at the different strand conductors 10A, 10B and 10C may remain constant.

In general, the series static capacitance of the interleaved coil is in proportion to the number of turns (N) of the disk-like coil and the dimension W of the strand conductor in the axial direction and in reciprocal proportion to the thickness t of the insulation provided between adjacent strand conductors. Accordingly, the coils of the block disposed on the line terminal side can be increased in respect of the series static capacitance by increasing the number of turns $N_I$ and the dimension in the axial direction of the winding, and additionally the freedom in reducing gradually the distribution of the series capacitance can be enhanced significantly.

Figure 3:
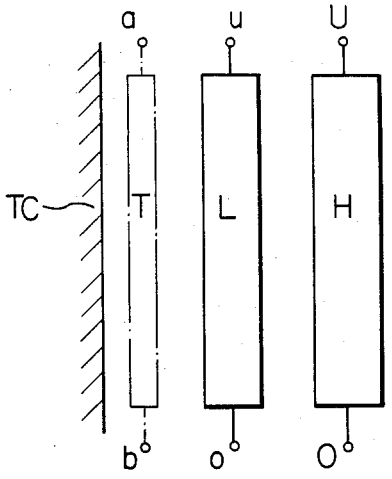
FIGS. 3, 4 and 5 illustrate exemplary dispositions of windings in transformers to which the winding according to the invention is applied.
Figure 4:
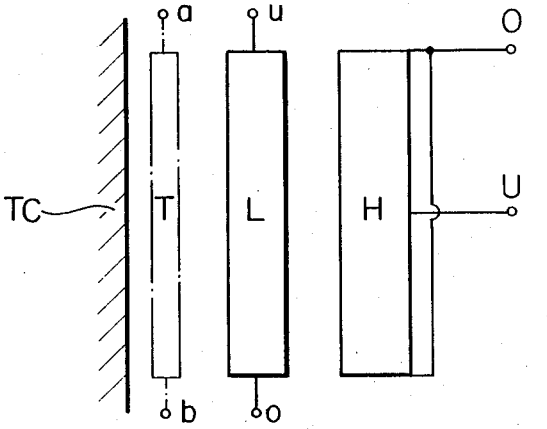
Figure 5:
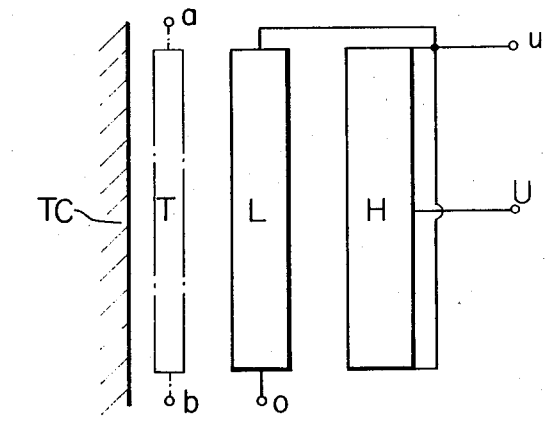

The transformer winding of the structure described above, according to the present invention, can be formed of a single continuous strand conductor extending continuously from the top end to the bottom end of the winding in a manner illustrated in FIG. 1 and wound around a leg portion of the iron core TC as a high voltage winding H together with a low voltage winding L, and if desired, a tertiary winding T in a coaxial manner, as is illustrated in FIG. 3. Further the transformer winding according to the invention can be used in a connection shown in FIG. 4 in which a center point of the winding serves as the line terminal U while the upper and the lower ends of the winding are connected together in parallel connection to serve as the other terminal O in a multi-winding type transformer. In FIGS. 3, 4 and 5, reference characters u and o denote low voltage terminals, while a and b denote tertiary terminals. In the case of the connecting arrangement of the windings shown in FIG. 5, the winding according to the invention is made use of as a high voltage series winding H in an autotransformer with a center tap thereof being used as the line terminal U, while the upper and the lower ends u of the winding H are combined together in a parallel connection which is then connected in series with a shunt winding L which may be constituted by conventional non-interleaved disk-like coils or constituted at least partially by the interleaved coils and wound around the leg portion TC of the iron core together with a tertiary winding T. Of course, other connections of the windings may be adopted, as occasion requires.

Figure 6:
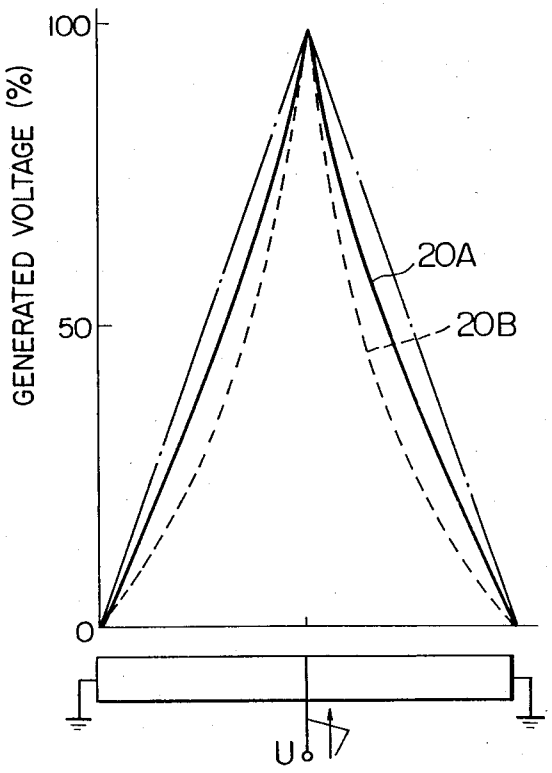
FIG. 6 illustrates graphically and comparatively an initial potential distribution brought about by lightning surges in a winding for the static induction apparatus according to the invention which has a line terminal provided at a center or mid point as viewed in the axial direction of the winding.

FIG. 6 graphically illustrates the initial potential distribution along the axial direction of the winding as brought about in response to impression of a lightning surge where the windings according to the invention are stacked one on another and connected in a parallel relation. As can be seen from this figure, the curve 20A representing the potential distribution in the winding according to the invention approximates more an ideal uniform potential distribution curve depicted by a single-dotted broken line as compared with a potential distribution curve 20B for an interleaved winding of a hitherto known structure and is more linearized. It will thus be understood that the impulse voltage characteristics can further be improved, resulting in an enhanced reliability and stability of insulation.

Further, when the windings of the structure shown in FIG. 1 are stacked one on another axially, connected in parallel and used as a transformer winding, significantly advantageous effect which is of importance in design can be attained in the reduction of eddy current loss in the strand conductor due to leakage flux. More specifically, leakage flux produced in the static induction apparatus such as a transformer at the axially center portion of the winding at which the winding is connected to the line terminal contains predominantly flux components of the axial direction. Under the condition, the structure of the interleaved coil located at this portion in which the radial dimension of the strand conductor constituting the coil is reduced to increase the number of turns of the coil is also effective for diminishing the eddy current loss. On the other hand, since flux components of the radial direction are predominant in the winding end regions located close to the upper and the lower yokes of the iron core, the reduced axial dimension of the strand conductors constituting the interleaved coils disposed at these regions is also effective for reducing the eddy current loss.

Figure 7A:
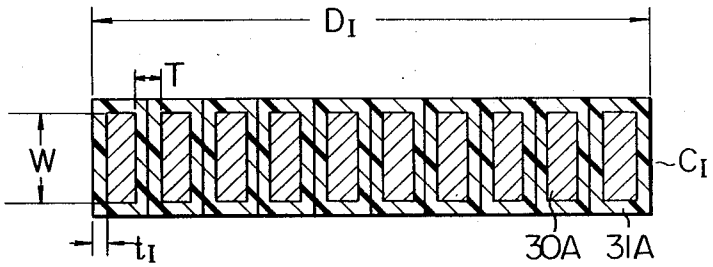
FIGS. 7A and 7B are enlarged sectional views showing, respectively, other examples of coils employed in the winding according to the invention.
Figure 7B:
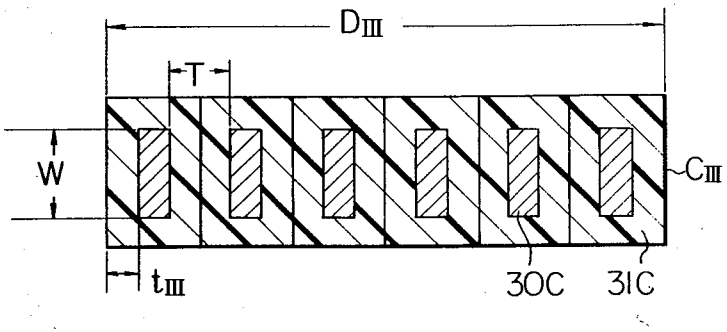

FIGS. 7A and 7B show structures of the interleaved coils $C_I$ and $C_{III}$ belonging to the coil blocks I and III, respectively, according to another embodiment of the invention. The structures of the interleaved coils illustrated in these figures assure the appropriate distribution of the series static capacitance throughout the winding constituted by these coils $C_I$, $C_{II}$ (not shown), $C_{III}$ and improved insulation characteristics. As can be seen from these figures, the cross-sectional configuration and dimensions or size of the strand conductors constituting the interleaved coils are same throughout all the blocks I, II and III. For attaining the intended distribution of the series capacitance and the improved insulation, the thickness of the insulation coat such as kraft paper applied to the strand conductor is varied in dependence on the blocks to which the respective interleaved coils belong. More particularly, in the case of the interleaved coil $C_I$ belonging to the coil block I located closest to the line terminal U shown in FIG. 1, the strand conductor 30A is applied with the insulation coat 31A having a thickness of $t_I$ and wound to form the coil $C_I$. On the other hand, in the case of the interleaved coil $C_{III}$ belonging to the coil block III disposed closest to the other terminal, the strand conductor 30C is applied with the insulation coat 31C having a greater thickness $t_{III}$ than that of the insulation coat 31A for the conductor 30A. The thickness of the insulation coat applied to the strand conductor forming the interleaved coil $C_{II}$ which belongs to the coil block II located between the blocks I and III is selected to lie between the thickness $t_I$ and $t_{III}$, although the insulated strand conductor for the coil $C_{II}$ is not shown in these figures. In this manner, the number of turns of each interleaved coil $C_I$, $C_{II}$, $C_{III}$ can be selected such that the relation: $N_I > N_{II} > N_{III}$ described hereinbefore is established.

The interleaved coils $C_I$, $C_{II}$ and $C_{III}$ formed of the respective strand conductors enclosed by the insulation coats having different thicknesses allow the winding to be manufactured with the radial dimensions $D_I$, $D_{II}$ and $D_{III}$ of the coils $C_I$, $C_{II}$ and $C_{III}$ being maintained substantially same without resorting to the use of the insulation spacer or the like.

As described hereinbefore, the series electrostatic capacitance of the disk-like interleaved coil is in proportion to the number of turns N of the coil and to the dimension W of the strand conductor in the axial direction of the coil, but is in reciprocal proportion to the thickness T of the insulation layer located between the adjacent turns of the strand conductor. Accordingly, it is possible to attain a great series capacitance in a gradient distribution in the winding by increasing the number of turns N of the interleaved coil and reducing the thickness of the insulation coat in the coil block located closest to the line terminal. Further, the radial dimensions of the interleaved coils belonging to the different blocks can be made substantially uniform without resorting to the use of other means. Thus, local concentration of the electric field can be positively prevented. For these reasons, it can be said that the structure of the interleaved coil illustrated in FIGS. 7A and 7B provides the advantages similar to those of the coil described hereinbefore in conjunction with FIGS. 2A and 2B.

Figure 8:
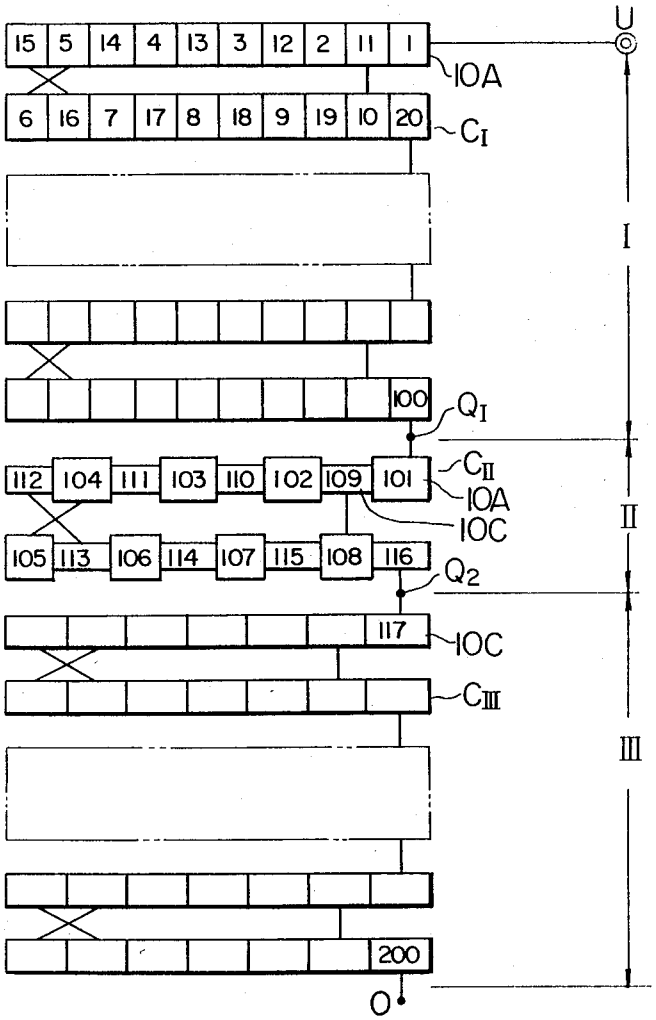
FIG. 8 shows schematically a structure of the winding for a static induction apparatus according to a further embodiment of the invention.

FIG. 8 shows a winding according to another embodiment of the invention. This winding is also divided into three blocks I, II and III including, respectively, a plurality of interleaved coils $C_I$, $C_{II}$ and $C_{III}$ in series circuit relation between the line terminal U and the other terminal O, similarly to the case of FIG. 1. In the block I located on the side of the line terminal U, each of the interleaved coils $C_I$ is wound as formed of an insulated strand conductor 10A having a diminished radial dimension and an increased axial dimension such as the one shown in FIG. 2A so as to increase the number of turns, while in the block III located close to the other terminal O, each of the interleaved coils $C_{III}$ is formed of an insulated strand conductor 10C having a greater radial dimension and a reduced axial dimension such as the one shown in FIG. 2B to thereby reduce the number of turns. In the intermediate block II, there are provided a pair of interleaved coils $C_{II}$ each of which is formed by winding the strand conductors 10A and 10C described above in the interleaved manner for a predetermined number of turns. In this case, when the strand conductor 10A is led out from the final turn 100 of the lowermost interleaved coil $C_I$ belonging to the block I without being cut and wound together with the strand conductor 10C for forming the coil $C_{III}$ in the block III in a paired combination thereby to form the interleaved coil $C_{II}$ so that the strand conductor 10A constitutes the first turn 101 of the coil $C_{II}$, then there arises no physical discontinuation in the connection between the coils $C_I$ and $C_{II}$ with respect to the conductor 10A, whereby the otherwise required process for making electric connection at a mid point $Q_1$ can be spared. In a similar manner, at transition from the block II to the block III, the strand conductor 10C is led out from the last turn 116 of the interleaved coil $C_{II}$ without being cut and wound together with the identical counterpart conductor 10C to thereby form the interleaved coil $C_{III}$ belonging to the block III, whereby the otherwise required electrical connection at a mid point $Q_2$ can be spared, since no electrical discontinuation is present between the coils II and III with respect to the conductor 10C. In this manner, by interposing the coil block II including a pair of interleaved coils formed of the paired strand conductors 10A and 10C of the coils $C_I$ and $C_{III}$, respectively, between the blocks I and III, the electrical connections between the adjacent coil blocks become unnecessary, whereby the winding operation can be effected in a continuous manner.

The interleaved winding of the structure illustrated in FIG. 8 provides the advantages described hereinbefore and allows the series static capacitance of large capacity to be established with an increased freedom in distributing the electrostatic capacitance in a progressively decreased distribution from the high voltage end toward a low voltage end of the winding. Besides, electrical connection is rendered unnecessary, reliable insulation is attained and the manufacturing of the winding in much facilitated, to the additional advantages.

Figure 9:
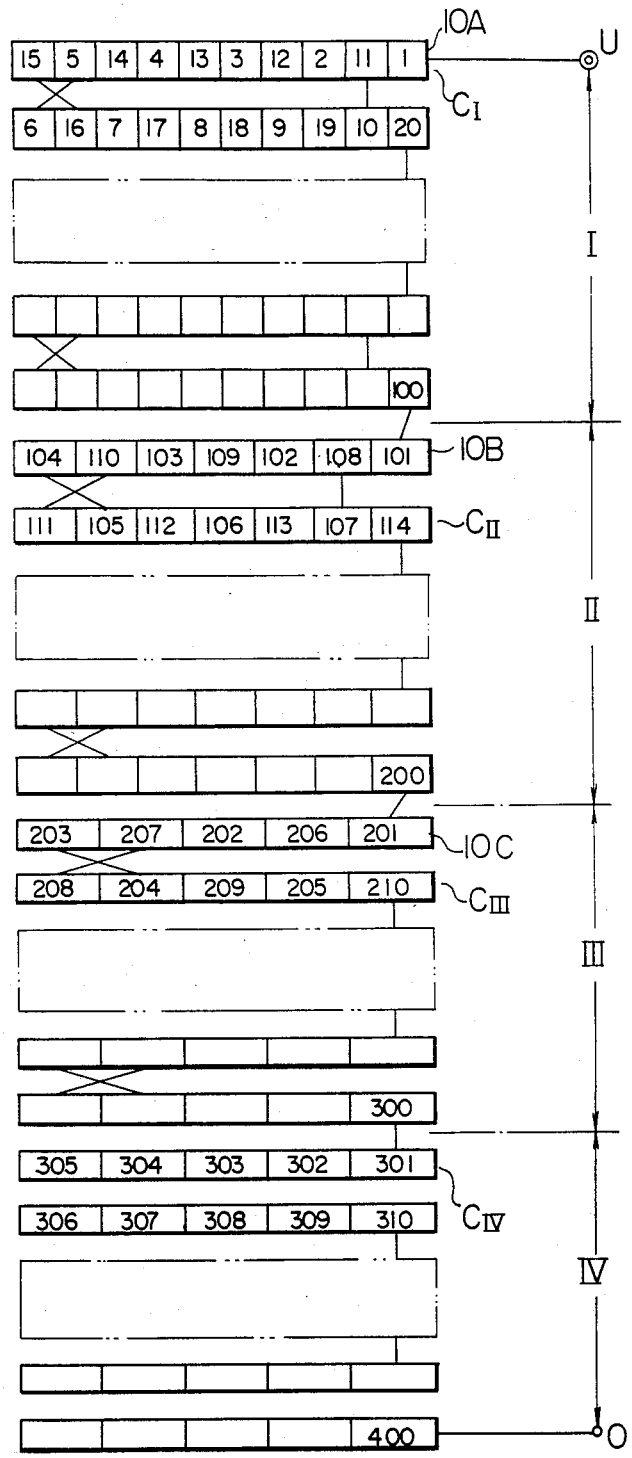
FIG. 9 shows schematically a structure of the winding for a static induction apparatus according to still another embodiment of the invention.

FIG. 9 shows a winding according to still another embodiment of the invention which differs from the structure of the winding shown in FIG. 1 in that a fourth coil block IV is provided closest to the other terminal O in addition to the blocks I, II and III including, respectively, the interleaved coils $C_I$, $C_{II}$ and $C_{III}$ in the arrangement similar to those shown in FIG. 1. The block IV includes a plurality of conventional (non-interleaved) coils each formed of the same strand conductor as the conductor 10C and exhibiting more reduced series capacitance. With this structure of the winding, not only the advantages of the winding structure shown in FIG. 1 can be obtained, but also more improved distribution of the series electrostatic capacitance can be established in a progressively decreasing manner starting from the line terminal U side toward the other terminal O.

In carrying out the invention, the number of blocks constituting the winding may be selected rather arbitrarily. However, it is practical to determine the number of the coil blocks in consideration of the surge characteristics required in actual design of the static induction apparatus as well as the manufacturing process, because formation of the interleaved coils having different numbers of turns by using the strand conductors of different types involves necessarily preparing a correspondingly increased number of different type strand conductors as well as complicated manufacturing processes.

In the foregoing description, it has been assumed that any of the interleaved coils is formed of a single conductor. However, it will be appreciated that paralleled strand conductors or transposed conductor including a number of fine strands and encased in an insulation sheath may be employed when the current capacity of the winding to be manufactured has to be increased. Further, various interleaved structures known in the art may be made use of.

In the windings for static induction apparatus according to the invention described above, the potential distribution in the axial direction of the winding can be much linearized with the decreased distribution constant $\alpha$ by virture of the arrangement that the series static capacitance of the coils belonging to the different blocks can be decreased stepwise as the conductor proceeds from the line terminal side toward the other terminal side, whereby improved surge voltage characteristic as well as reliable insulation of the winding can be accomplished. Further, since no special insulation spacers are used, the space factor of the winding is increased so that the volume of the winding can be reduced significantly.

What we claim is:

1. A winding for a static induction apparatus comprising a plurality of interleaved coils each formed by winding a strand conductor in a radial spiral, said coils being stacked in the axial direction of said coils and electrically connected in series from a line terminal side to another terminal side, wherein said winding is divided into at least three blocks each including a plurality of ones of said interleaved coils each of the interleaved coils which belong to a first one of said blocks located on said line terminal side being formed by winding a first type strand conductor having a reduced dimension in the radial direction of said coil and an increased dimension in the axial direction of said coil, while each of the interleaved coils which belong to a second one of said blocks located closer to said other terminal side is formed by a second type strand conductor which has an increased dimension in the radial direction of said coil and a reduced dimension in the axial direction in contrast to the dimensions of said first type strand conductor and has an electrically effective cross-sectional area substantially equal to that of said first type strand conductor, each of the interleaved coils belonging to a third one of said blocks interposed between said first and second blocks being formed by winding a pair of said first and second type strand conductors disposed adjacent to each other, the number of turns of each of the interleaved coils belonging to said second block being decreased as compared with that of each of the interleaved coils belonging to said first block.

2. A winding for a static induction apparatus according to claim 1, wherein said winding comprises a fourth block including a plurality of non-interleaved disk-like coils and disposed between said second block and said other terminal such that the interleaved coils of said second block reach said other terminal through said non-interleaved coils of said fourth block in a series circuit relation.

3. A winding for a static induction apparatus according to claim 1, wherein an additional winding which is the same as said winding previously defined in structure is used in an assembly, both winding being axially stacked with the line terminal side of each winding at an intermediate portion in the axial direction of said winding assembly and with the respective other sides of the former and the windings at the opposite outer sides of said winding assembly.

* * * * *